US005467992A

United States Patent [19]

Harkness

[11] Patent Number: 5,467,992

[45] Date of Patent: Nov. 21, 1995

[54] GOLF SWING TRAINING METHOD

[75] Inventor: Scott Harkness, Bracebridge, Canada

[73] Assignee: Dynalaser Inc., Ontario, Canada

[21] Appl. No.: 178,415

[22] Filed: Jan. 6, 1994

Related U.S. Application Data

[63] Continuation-in-part of Ser. No. 997,929, Dec. 29, 1992, abandoned.

[51] Int. Cl.[6] ..... A63B 69/36

[52] U.S. Cl. ..... 273/187.2; 362/106; 273/190 A; 273/DIG. 17

[58] Field of Search ..... 273/187.2, DIG. 17, 273/190 A; 434/252; 362/105, 106

[56] References Cited

U.S. PATENT DOCUMENTS

| | | | |
|---|---|---|---|
| 1,169,188 | 1/1916 | Peck | 273/187.2 |
| 2,571,974 | 10/1951 | Walker | 273/186 R |
| 2,929,631 | 3/1960 | Gillon | 273/163 |
| 3,087,049 | 4/1963 | Schecter | 362/105 |
| 3,228,696 | 1/1966 | Hull | 273/187.2 |
| 3,953,034 | 4/1976 | Nelson | 273/186.3 |
| 4,079,940 | 3/1978 | Arakaki | 273/187.2 |
| 4,098,509 | 7/1978 | Van Krevelen | 273/187.2 |
| 4,108,441 | 8/1978 | Tredway, Sr. | 273/186.3 |
| 4,303,244 | 12/1981 | Uppvall | 273/DIG. 17 |
| 4,406,040 | 9/1983 | Cannone | 362/309 X |
| 4,560,166 | 12/1985 | Emerson | 273/187.2 |
| 4,971,325 | 11/1990 | Lipps | 273/187.2 |
| 5,082,282 | 1/1992 | Hernberg | 273/186.3 |
| 5,108,104 | 4/1992 | Johnson | 273/187.2 |
| 5,169,150 | 12/1992 | Tindale | 273/187.4 |
| 5,217,228 | 6/1993 | Aguilar | 273/186.3 |
| 5,284,345 | 2/1994 | Jehn | 273/187.2 |

FOREIGN PATENT DOCUMENTS 1134493 5/1992 Japan .

OTHER PUBLICATIONS

"The Patent Duffer: 101 incredible inventions from the wacky world of golf," Jordan Kaiser, Automatic Press Publishing, 1991, pp. 42–61.

*Primary Examiner*—George J. Marlo

[57] ABSTRACT

A method for using a light spot projecting aid to observe head movements during a golf swing and to provide a golfer with an explanation (i.e., cause) of the effect manifested as the light spot being moved. The aid includes a light source, such as a laser, that is mounted to a person's head by fastening the light source to a hat. The light source projects a light spot into a hitting area to provide a continuous visual indication of head movement during the swing. The observed path of the light spot movement is compared with a set of cause and effect relations relating swing mechanics to areas covered by portions of the observed path, thereby aiding diagnosis of golf swing conditions.

4 Claims, 6 Drawing Sheets

GOLF SWING TRAINING METHOD

This application is a continuation-in-part of Ser. No. 7/997929, filed Dec. 29, 1992, now abandoned.

FIELD OF THE INVENTION

The present invention relates to the field of teaching aids and, in particular, to aids for identifying faults in golf swings or the like.

BACKGROUND OF THE INVENTION

A steady or "quiet" head is a fundamental aspect of an effective golf swing. The head is the hub of the golfer's swing axis and any excessive movement of the head directly translates into a shift of the swing axis. When the swing axis shifts, the clubhead path is altered and a poor golf shot typically results.

Rudimentary devices are known for permitting a golfer to actively identify when his head is moving. Such devices range from motion detecting alarms to spotlights mounted to a golfer's hat. While providing a general indication of head movement, these devices do not adequately identify the direction and extent of a golfer's head movement during each phase of his golf swing. The devices also tend to be cumbersome to wear and impractical to use during an actual round of golf.

There is a need for a device that permits a golfer to observe the extent and direction of his head movements during each phase of his golf swing. Furthermore, there is a need for a method of utilizing such head movement information to enable a golfer to identify potential faults in his swing.

SUMMARY OF THE INVENTION

In a first aspect, the present invention provides an aid for observing head movements during a swing, comprising:

a light source for projecting a lightspot to a hitting area to provide a continuous visual indication of head movement during the swing;

means for coupling a power source to said light source;

means for fastening said light source to a hat; and means for moving said light source relative to said hat to adjust the position of said projected lightspot in said hitting area.

In a second aspect, the invention provides an aid for observing head movements during a swing, comprising:

a hat having a cavity defined in its brim; and a module having a top portion and a bottom portion, said top portion being adapted to releasably fit in said cavity, and said bottom portion supporting a light source for projecting a light spot into a hitting area, said module containing means for coupling a power source to said light source.

In a third aspect, the present invention provides a method for a person to identify his potential swing faults, comprising the steps of:

placing an apparatus on his head for projecting a light spot to a hitting area;

performing a swing through said hitting area and observing the path of movement of said light spot throughout said swing; and comparing said observed path with a predetermined swing fault path to identify one or more potential swing faults.

The method further includes, during said comparing step, the potential swing fault of lifting the head being indicated by light spot movement in a direction normal to the plane of the swing and away from the person swinging. Also, the method further includes, during said comparing step, the potential swing fault of straightening up being indicated by light spot movement in a direction normal to the plane of the swing and toward the person swinging.

Advantageously, the method enables a golfer to observe his own head movements and use these observations to identify one or more potential swing faults. The golfer is thus able to continually work upon improving his golf swing without requiring the assistance of another individual's observations or of video replays.

BRIEF DESCRIPTION OF DRAWINGS

For a better understanding of the present invention, and to show more clearly how it may be carried into effect, reference will now be made, by way of example, to the accompanying drawings. The drawings show a preferred embodiment of the present invention, in which.

DETAILED DESCRIPTION OF THE PREFERRED EMBODIMENT

An aid in accordance with the present invention is shown generally at 10 in the Figures. The aid 10 is mounted to a golfer's head to provide the golfer with an indication of the extent of his head movement during a golf swing. It will be appreciated that the aid 10 could be used by persons other than golfers to assist them in observing head movements to correct an athletic swing or the like.

Figure 2:
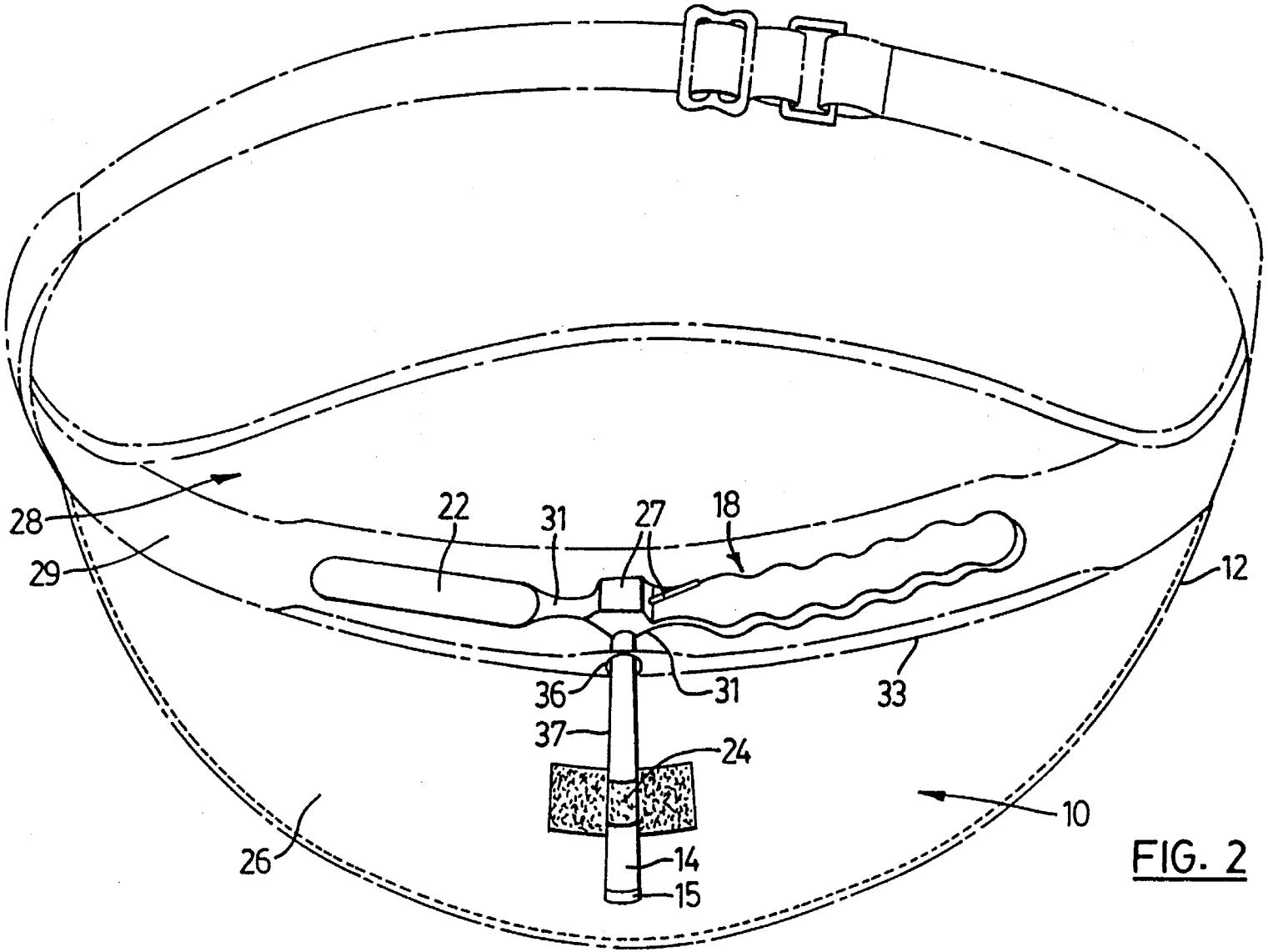
FIG. 2 is a perspective view, from behind, of the golfing aid of FIG. 1 mounted to an article of headwear (shown in phantom)
Figure 3:
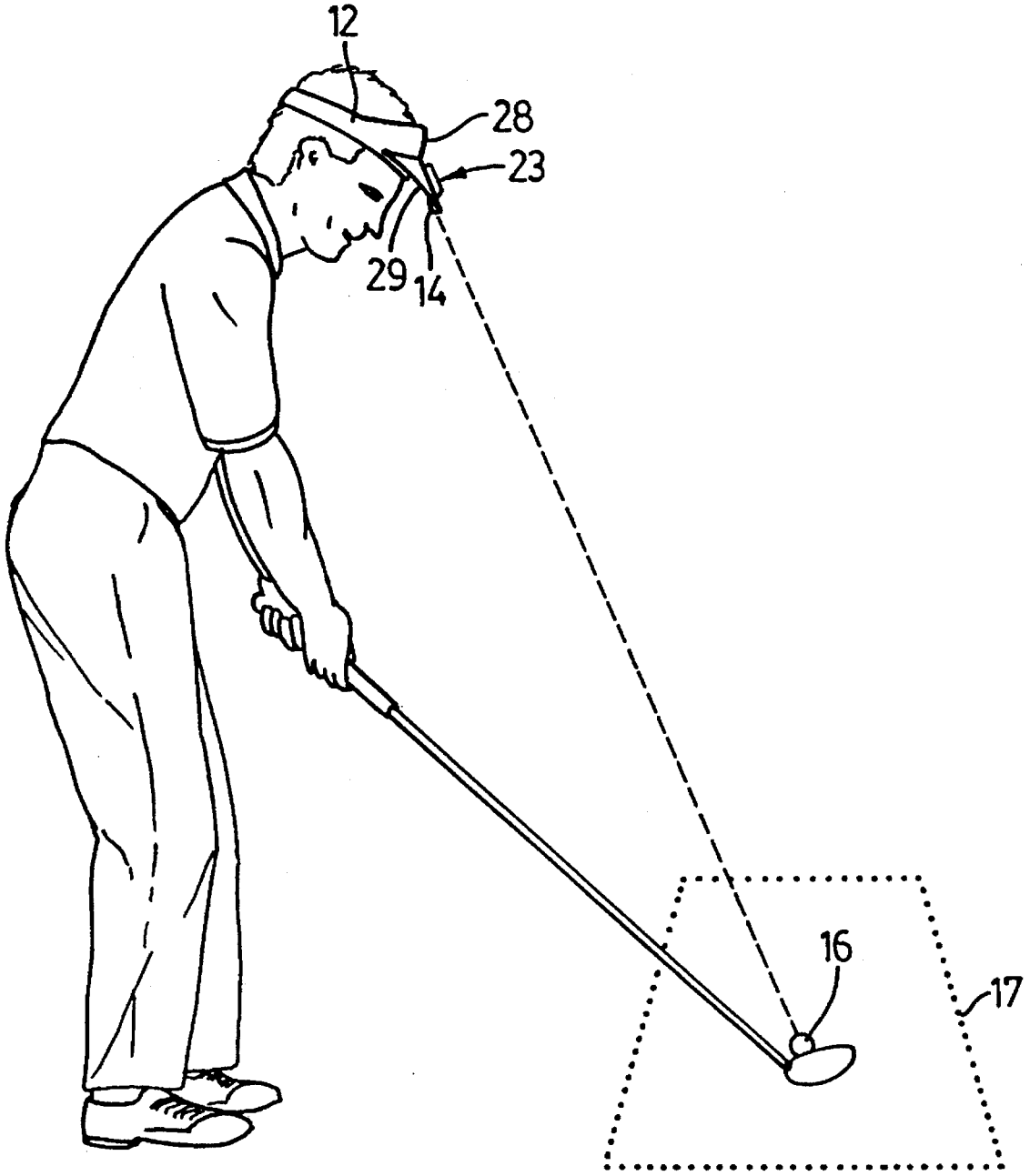
FIG. 3 is a perspective view of a golfer addressing a golf ball while wearing a golfing aid in accordance with the present invention.

As shown in FIGS. 2 and 3, the aid 10 may be mounted to a golfer's head by combining the aid 10 with a mounting means such as an article of headwear 12. Conceivably, other mounting means, such as headbands or glasses, may also be adapted for mounting the aid 10 to the golfer's head.

The aid 10 includes a light source 14 for translating movements of the golfer's head during his golf swing. The light source 14 translates the golfer's head movements by directing a visible light spot 16 into a hitting area 17 (an example of the hitting area 17 is indicated by the dotted outline on the ground surrounding the golf ball in FIG. 3). The hitting area 17 includes the golf ball (or the area where the golf ball is intended to be located, if the golfer is practicing his swing without hitting the golf ball), as well as the general area of the ground surrounding the golf ball. The light spot 16 is directed into the hitting area 17 so that its movements may be observed by the golfer during his golf swing. In addition to indicating the golfer's head movements, the light spot 16 helps the golfer concentrate upon retaining eye focus upon the golf ball.

The light spot 16 should be visible during daylight conditions to permit the aid 10 to be used during an actual round of golf. A laser 14 is a suitable light source for emitting such a visible light spot 16. The laser 14 should be light-weight, compact, relatively inexpensive, and capable Of being powered by a low-voltage power source 18. The laser 14 used in the preferred embodiment is a diode laser, however other types of light-weight lasers 14, such as a Helium-Neon laser, may be used instead. A red, oblong-shaped light spot 16 is produced by the laser and is generally visible during daylight conditions. A lens 15 may be fastened to the free end of the laser 14 to further focus the light spot 16 if desired.

The preferred means for powering the light source 14 is a low-voltage power source 18. The light source 14 and the power source 18 are connected by a flexible electrical extension 37.

Figure 1:
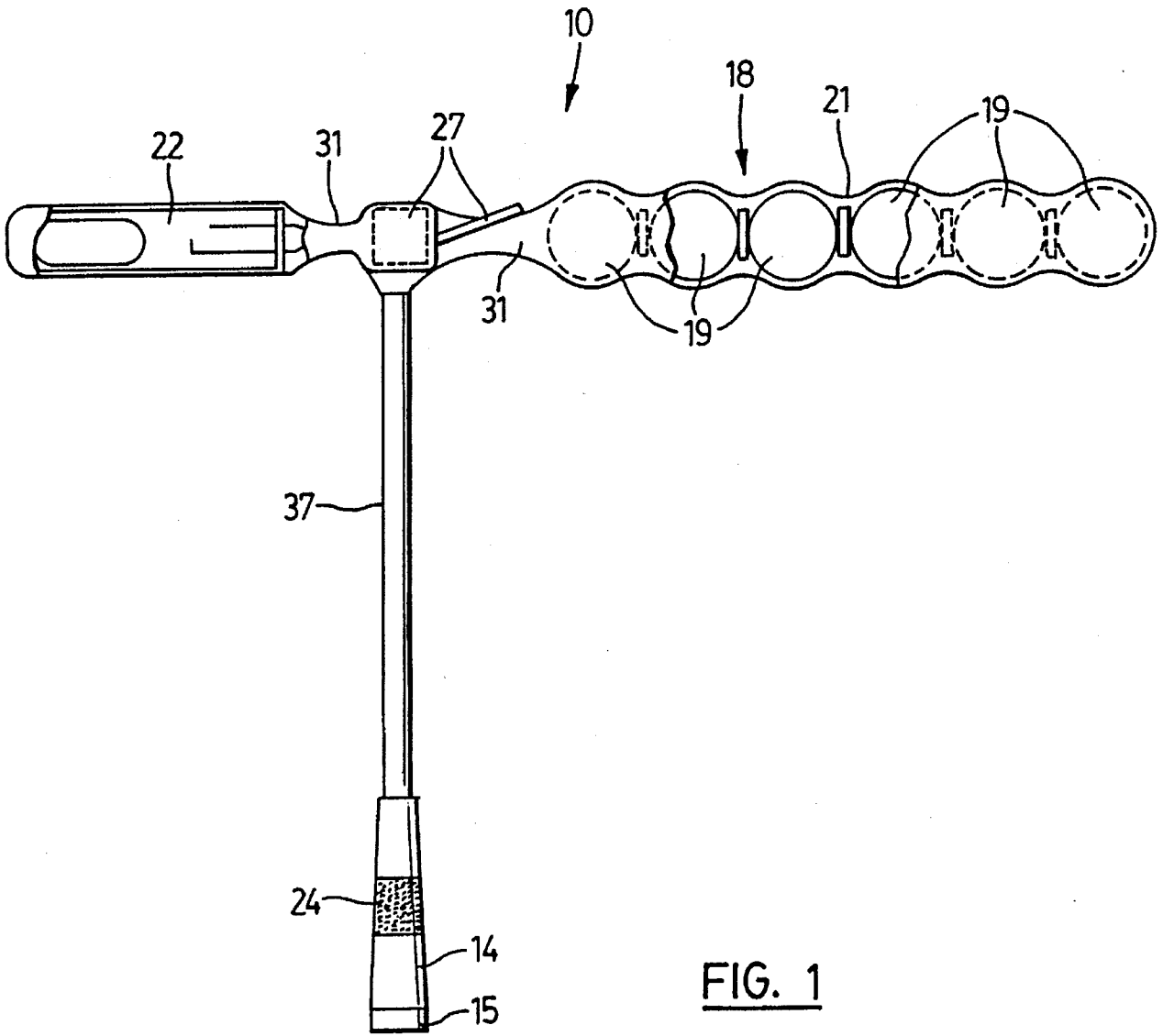
FIG. 1 is a perspective view of a first embodiment of a golfing aid in accordance with the present invention, with portions of a wrapping removed to reveal a switch and batteries.

In a first embodiment of the invention as shown in FIG. 1, the power source 18 consists of a series of 1.5 volt watch batteries 19 contained within a flexible battery pack 21. The battery pack 21 is made of rubber or another appropriate light-weight material that is flexible along its length. The flexible battery pack 21 may thus be comfortably arranged within the article of headwear 12 as shown in FIG. 2 and described further below. In second and third embodiments of the invention, as shown in FIGS. 4–5 and 7–9, the power source consists of a single 9-volt battery.

An alternate low-voltage power source, such as a solar cell 23 (shown generally in FIG. 3), may be used instead of the batteries 19 or in addition to the batteries 19 as a means of recharging the batteries 19. For exposure to sunlight, the solar cell 23 may be attached to an upper surface of the article of headwear 12 with an attachment means (not shown), such as glue or tape.

The light source 14 and power source 18 are connected by means of an electric circuit to a switch 22, such as a mercury tilt switch, for activating the light source 14. The mercury tilt switch 22 reacts to motion and thus may be arranged to automatically activate the light source 14 when the golfer lowers his head into an address position (see FIG. 3). When the golfer's head is in an upright or raised position (not shown), the light source 14 is automatically deactivated. The mercury switch 22 thus allows "hands free" operation of the aid 10.

A master switch 27 may also be provided, in addition to the mercury switch 22, to permanently deactivate the light source 14 when the aid 10 is not being used. This reduces the likelihood of the light source 14 becoming accidentally activated and draining the batteries 19 when the aid 10 is being carried or stored in a lowered position. The master switch 27 may be a regular toggle switch or a timed switch that will deactivate the light source over a set period of time.

In the first embodiment shown in FIG. 1, a plastic wrapping 31 is shrunk over the mercury switch 22, master switch 27, battery pack 21, and the electric circuit to protect the components of the aid 10 and to combine them into a flexible, portable, one-piece unit, while still permitting simple battery replacement. The one-piece unit allows the aid 10 to be easily transferred from one article of headwear 12 to another depending upon what the golfer chooses to wear that day.

Most conventional articles of headwear 12 are easily adapted to receive the aid 10. As shown in FIG. 2, a conventional article of headwear 12 typically includes a brow band 29 arranged along the inside surface of the brow 28. The brow band is stitched along a seam 33 to the base of the brow to form a compartment between the brow 28 and the brow band 29. The first embodiment of the aid 10 is shaped to fit between the brow band 29 and the brow 28 with the light source 14 and extension 37 extending to the underside of the brim 26 through an opening 36 that is defined in the brow band. If the article of headwear 12 does not include a brow band 29, an equivalent compartment may be constructed to receive the aid 10.

A fastening means 24 is located on the underside of the brim 26 for attaching the light source 14. A hook and loop fastener 24, such as is sold in association with the trade mark VELCRO, is the preferred fastening means 24 for use with the first embodiment of the aid 10. The hook and loop fastener 24 is glued, taped, or otherwise attached to the underside of the brim 26 and also to the body of the light source 14. The light source 14 may then be movably fastened to the underside of the brim 26. The angle of the light source 14 may thus be easily adjusted so that the light spot 16 is directed into the hitting area 17 when the golfer lowers his head into a comfortable address position.

Figure 4:
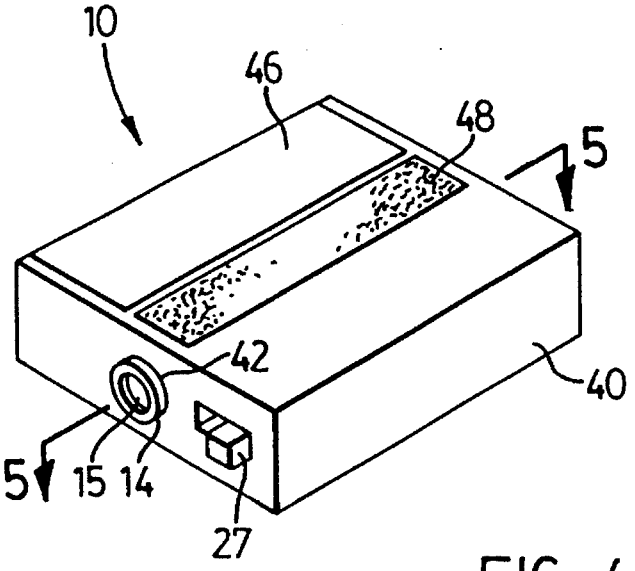
FIG. 4 is a perspective view of a second embodiment of a golfing aid in accordance with the present invention.
Figure 5:
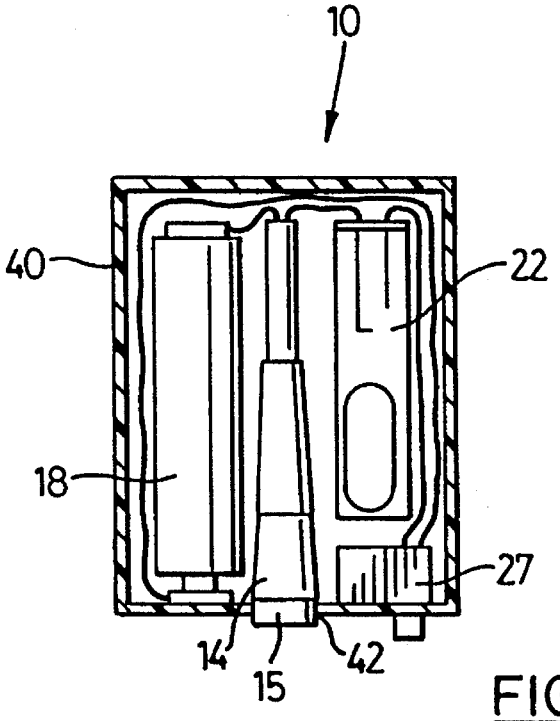
FIG. 5 is a sectional view of the golfing aid shown in FIG. 4 as taken along lines 5—5.

A second embodiment of the aid 10 is shown in FIGS. 4 and 5. In this embodiment, the components of the aid 10 are contained in a housing 40. The components include the light source 14, the power source 18, the mercury switch 22, and the master switch 27. All of the components are connected by means of an electric circuit.

The housing 40 defines an aperture 42 for allowing light from the light source 14 to exit the housing 40. The housing 40 also includes a removable cover 46 for accessing the contents of the housing 40, and in particular, for replacing the power source 18. A fastening means 48 extends from the housing 40 to enable the housing 40 to be releasably, and movably, fastened to the article of headwear 12. The fastening means 48 may consist of a hook and loop fastener (as shown), a pin, or any other suitable means for fastening the housing 40 to the article of headwear 12.

Figure 6:
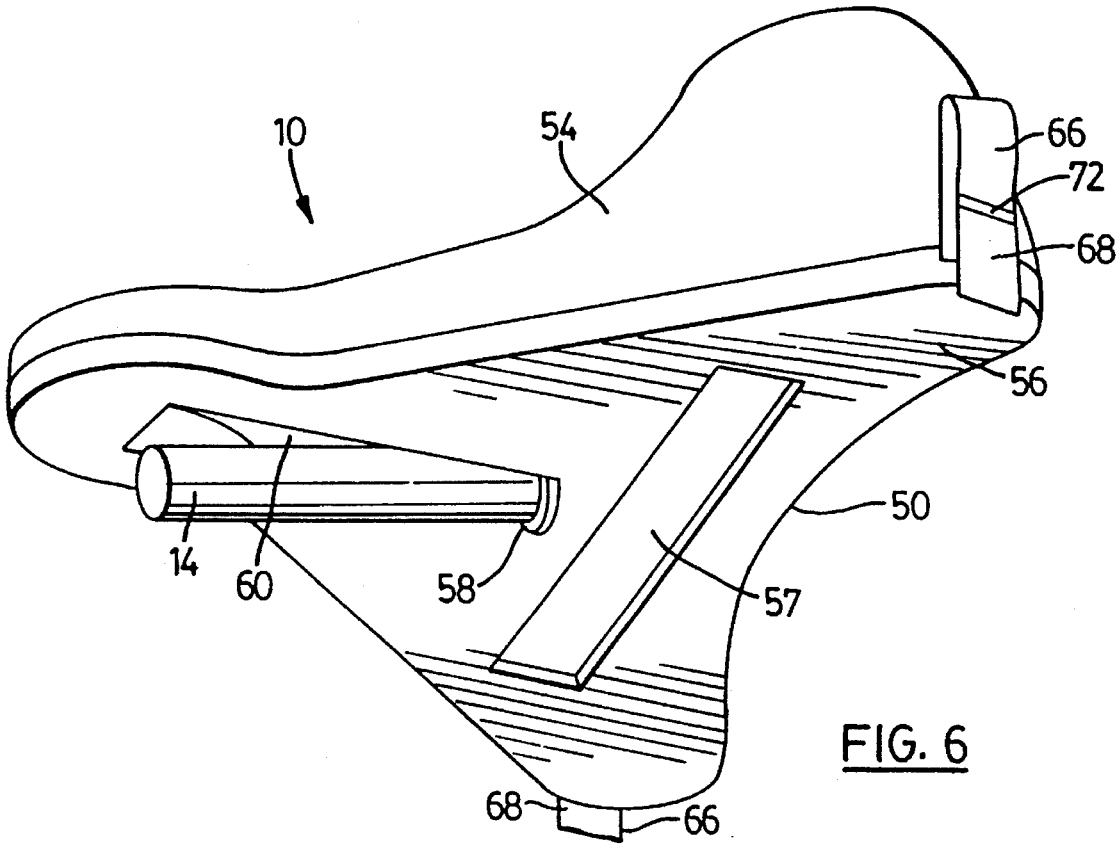
FIG. 6 is a perspective view of a third embodiment of a golfing aid in accordance with the present invention.
Figure 7:
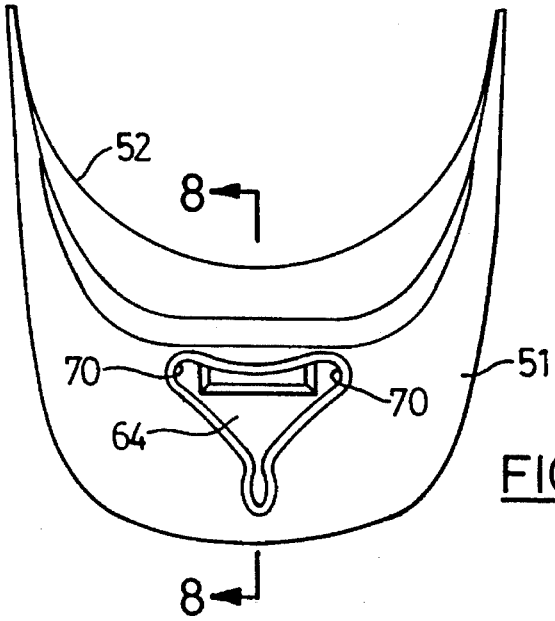
FIG. 7 is a bottom view of a hat in accordance with the present invention.
Figure 8:
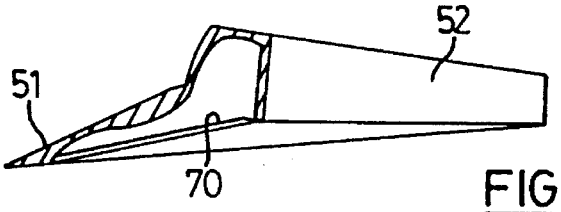
FIG. 8 is a sectional view of the hat of FIG. 7 taken along lines 8—8.

A third (and most preferred) embodiment of the aid 10 is shown in FIG. 6. In this embodiment, the components of the aid 10 are provided in a module 50 that is adapted to fit to the brim 51 of a specially designed hat 52 shown in FIGS. 7 and 8. The module 50 contains the mercury switch 22, the master switch 27 and the power source 18.

Referring to FIG. 6, the module 50 includes top and bottom plates 54 and 56. An opening 57 is defined in the bottom plate 56 for allowing insertion of the power source 18 into the module 50. The light source 14 is pivotally connected by a ball joint 58 to the bottom plate 56. The ball joint 58 permits movement of the light source 14 substantially in all directions below the bottom plate 56. When not in use, the light source 14 may be moved to fit within a receptacle 60 defined in the bottom plate 56. When in use, the light source 14 may be moved downwardly and from side to side relative to the bottom plate 56. This permits the light spot 16 to be precisely directed to a desired location in the hitting area 17 without requiring the golfer to adjust his hat or his head position.

The top plate 54 is shaped to fit within a corresponding cavity 64 that is defined in the brim 51 of the hat 52. The brim 51 is preferably formed of a lightweight plastic material that is injection moulded to form the cavity 64.

Spring clips 66 extend upwardly from the bottom plate 56 to provide a friction fit between the module 50 and the hat 52. Each clip 66 has a lower tab portion 68 that is adapted to project slightly below the bottom plate 56 when the module is fastened to the hat 52. The tab portions 68 can be squeezed inwardly to release the module 50 from the hat 52. A tongue 70 protrudes from the cavity 64 for engaging a corresponding groove 72 defined in the clips 66. This provides a "snap" lock for fastening the module 50 to the hat 52.

Figure 9:
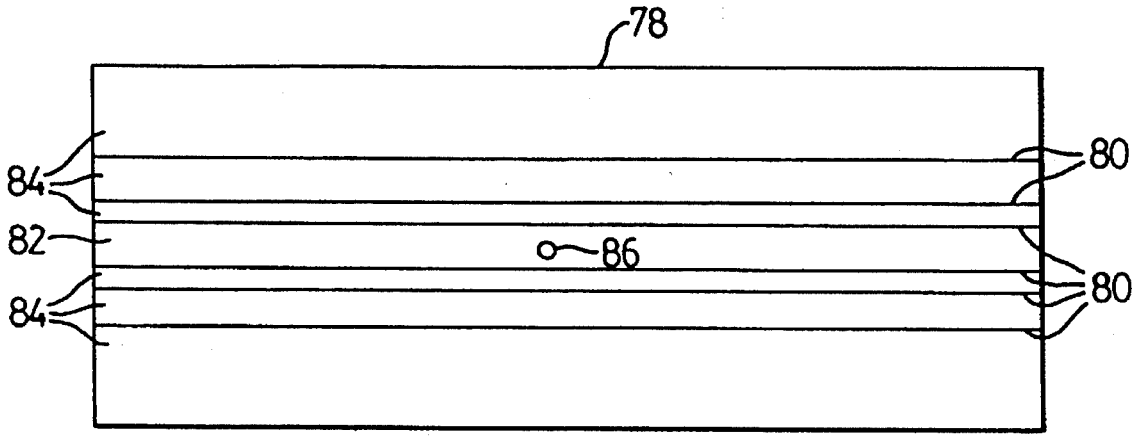
FIG. 9 is a top view of a mat in accordance with the present invention.

Referring to FIG. 9, a mat 78 is shown that may be located in the hitting area 17. The mat 78 allows the golfer to measure the extent and direction of the lightspot 16 movement during his swing. This is particularly helpful during the down swing and follow through stages of the swing, when the light spot 16 tends to move quickly. The mat 78 would typically be used only for swing practice, for instance at a driving range or for indoor putting practice. The mat 78 includes parallel markings 80 that define a desired swing plane 82 and successive levels 84 of light spot movement outside of the desired plane 82. Each successive level indicates more severe head movement by the golfer. A target spot 86, which might resemble a golf ball, is provided at the centre of the mat 78. The levels 84 are preferably color coded to allow the golfer to quickly recognize if the light spot 16 has reached a particular level 84.

Operation of Aid

The article of headwear 12, with the aid 10 attached, is adjusted to fit comfortably upon the golfer's head. The golfer assumes an address position with his head lowered as if he were about to swing at the golf ball. Adjustments are then made either to the position of the headwear 12, or to the position of the light source 14 relative to the headwear 12, in order that the light spot 16 is directed generally upon the golf ball in the hitting area 17. Care should be taken during this adjustment stage to ensure that the golfer's head is in a comfortable address position for the golf swing. The golfer should avoid moving his head to an uncomfortable position merely to line up the light spot 16 upon the golf ball. Once the headwear 12 and light source 14 have been appropriately adjusted, the golfer is ready to play golf and make use of the aid 10.

Each time the golfer addresses the golf ball, he lowers his head to the address position so that the light spot 16 is directed generally upon the golf ball. During all aspects of his swing, the golfer concentrates upon keeping the light spot 16 steady and generally near to the golf ball in the hitting area 17.

During the back swing, the golfer's head may turn to look slightly behind the golf ball to allow room for the golfer's shoulders to turn. During the down swing, the golfer's head may move slightly downward and backward in response to the driving movement of the legs and unwinding of the hips. During the follow through, the golfer's head may turn to look toward the intended path of the golf ball to allow room for the golfer's right shoulder (for right-handed golfers) to turn. Also, during each stage of the swing the head will move with the body when the golfer's weight is transferred from one leg to the other.

It is normal for such minor movements of the head to occur during the golf swing, and the golfer should not be concerned about keeping the light spot 16 absolutely still. The head should be steady, but not rigid. The aid 10 assists a golfer in identifying excessive movements of his head and upper body and helps the golfer to concentrate upon keeping his head steady and his eyes focused upon the golf ball.

Figure 10:
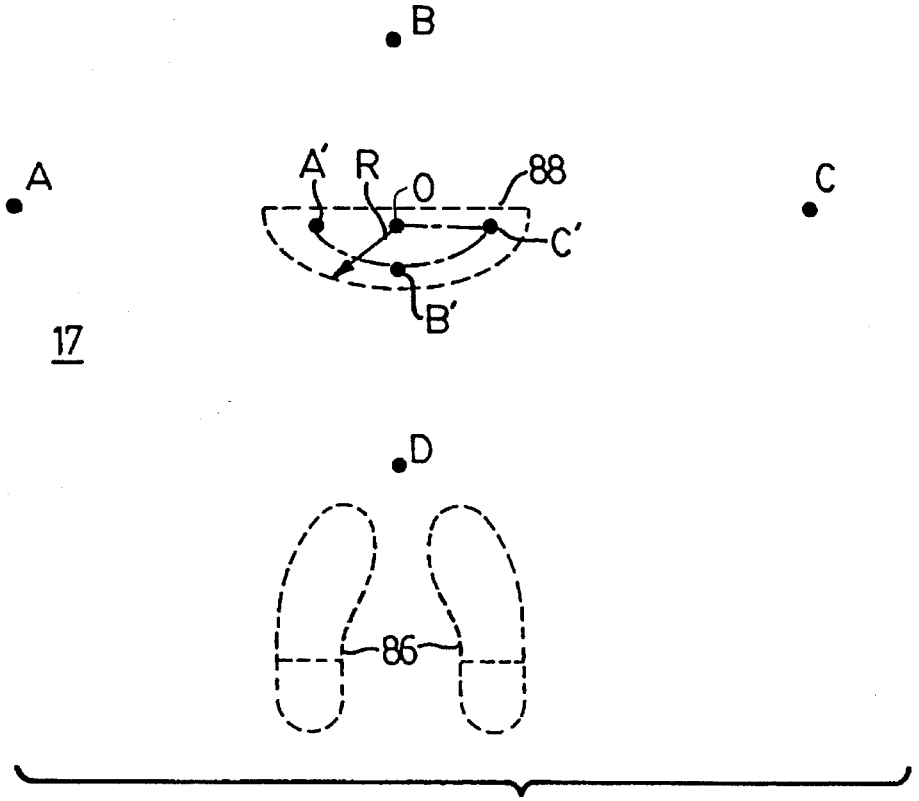
FIG. 10 is a schematic view of potential paths of lightspot movement in a hitting area in accordance with the method of the present invention.

Referring to FIG. 10, a schematic representation of the hitting area 17 (or surface) is provided with the golfer's feet being indicated at 86. Point O represents the originating point of the light spot 16 immediately prior to the swing. Points A, B, C and D represent possible points along the path of movement of the light spot 16 during the swing. Points A and C are located generally in the plane of the golf swing, and points B and D are located generally normal to the plane of the golf swing.

An imaginary buffer zone is indicated in dashed outline at 88. The light spot 16 would remain within the buffer zone 88 when the normal minor movements of the head occur during a proper golf swing as described earlier. In practice, the buffer zone 88 would have a radius R of approximately several inches relative to point O.

To identify a potential swing fault and a cause thereof, the golfer observes the path of movement of the light spot 16 throughout his golf swing. In particular, three stages of movement should be identified. Namely, the back swing, the down swing, and the follow-through. The golfer compares the observed path of movement during each stage of his golf swing to identify any potential swing faults during these stages. An example of a normal path of movement for a right-handed golfer is shown by the dot-dash path between points O C'B'A'. The movement from point O to C' represents normal movement during the back swing, from point C' to B' represents normal movement during the down swing, and from point B' to A' represents normal movement during the follow through. Movements outside of the buffer zone 88 represent excessive movements of the head that indicate a swing fault.

Movements in the plane of the swing (generally along lines OA or OC) indicate a potential swing fault involving an improper weight transfer of a golfer. For instance, if movement OC occurs during the back swing, an excessive weight shift to the golfer's right leg (for right-handed golfers) is probably occurring. Conversely, if movement OA occurs during the back swing, the golfer is improperly shifting his weight to his left leg instead of to his right leg as desired. Similar movements during other stages of the swing also would indicate improper weight transfers. These movements are summarized in the charts below relating particular areas of the surface (or hitting) area in which a portion of the observed path might be positioned (i.e., an effect) to particular swing mechanics in a particular swing stage (i.e., a cause)

If movement OB occurs, during any stage of the swing, the golfer is probably lifting his head and taking his eye off the ball. If movement OD occurs during any stage of the golf swing, the golfer is probably lifting his shoulders or straightening up during the swing and thus "chopping" at the ball. These movements are also summarized in the charts below.

| Reference Point | SWING STAGE: Back Swing | Down Swing | Follow-Through |
|---|---|---|---|
| POTENTIAL SWING FAULTS (RIGHT-HANDED SWING) | | | |
| A | Weight transfer to wrong leg | Weight transfer to wrong leg | Excessive weight transfer |
| B | Lifting head | Lifting head | Lifting head |
| C | Excessive weight transfer | Excessive weight transfer | Weight transfer to wrong leg |
| D | Straightening up | Straightening up | Straightening up |
| POTENTIAL SWING FAULTS (LEFT-HANDED SWING) | | | |
| A | Excessive weight transfer | Excessive weight transfer | Weight transfer to wrong leg |
| B | Lifting head | Lifting head | Lifting head |
| C | Weight transfer to wrong leg | Weight transfer to wrong leg | Excessive weight transfer |
| D | Straightening up | Straightening up | Straightening up |

Over the course of the entire golf swing, the light spot 16 may move through a number of positions. This would indicate a combination of swing faults as identified above. A combination of swing faults would also be indicated by the light spot 16 moving between points A, B, C and D. For instance, if the light spot 16 moved to a point between points A and B during the down swing of a right-handed golfer, then the golfer is probably both lifting his head and placing his weight on the wrong leg.

Accordingly, through repetition, a golfer will be able to identify his common swing faults and begin to take steps (perhaps with the assistance of a golf pro) to correct his swing. During practice, the golfer could use the mat 78, described earlier, to measure the extent of his head movements.

It is to be understood that what has been described are preferred embodiments of the invention. The invention nonetheless is susceptible to certain changes and alternative embodiments fully comprehended by the spirit of the invention as described above, and the scope of the claims set out below. The invention is described for use in assisting a golfer with his golf swing. It should be understood that other uses of the invention are conceivable. A hockey player, for instance, may conceivably use the invention to improve his accuracy and power in shooting the puck. In such a case, the aid might be mounted to the player's helmet. Other uses, for sports or simply for the improved performance of certain physical tasks, are also conceivable.

I claim:

1. A method of diagnosing golf swing conditions related to a golfer's head movement, comprising the steps of:

(a) placing an apparatus on a golfer's head for projecting a visible light spot onto a surface having particular areas thereon;

(b) observing, subsequent to the step (a), an initial position of the light spot on the surface prior to performing the golf swing, the initial position being:

an originating point for any subsequent light movement; and a reference point about which the particular areas on the surface are oriented;

(c) the golfer performing, subsequent to the step (b), a golf swing;

(d) observing, subsequent to the step (c), a path of movement of the light spot over the surface relative to the originating point resulting from the movement of the golfer's head caused by his golf swing;

(e) providing the golfer with a set of cause and effect relations, an effect being a particular area of the surface over which a portion of the observed path might be positioned, and a related cause being a particular swing mechanics explanation for why the golfer's head moved, such head movement causing the condition manifest as the portion of the observed path becoming positioned in the particular area of the surface; and (f) comparing, subsequent to the step (d), the observed path of the light spot with the set of cause & effect relations to obtain a diagnosis of a cause for a particular swing condition, related to the golfer's head movement.

2. A method as in claim 1, further comprising the step of:

(g) positioning, subsequent to the step (a) and prior to the step (b), the golfer's head into an address position for performing the golf swing.

3. A method as in claim 1, wherein:

the step (c) of performing a golf swing producing a swing including:

a back swing stage;

a down swing stage; and a follow-through stage;

wherein the particular swing mechanics explanation resulting from the step (f) identifies at least one of said swing stages.

4. A method as in claim 1, further comprising the step of:

(h) identifying a swing plane being substantially defined by the golfer's swing;

the particular swing mechanics explanation, resulting from the step (f) of comparing, identifying swing mechanics including at least one of:

improper weight transfer, corresponding to a portion of the path being positioned generally parallel to the swing plane on either side of the originating port;

lifting the head, corresponding to a portion of the path being positioned generally normal to the swing plane and away from the golfer; and straightening up, corresponding to a portion of the path being positioned generally normal to the swing plane and towards the golfer.

* * * * *